US005746931A

United States Patent [19]

Graebner et al.

[11] Patent Number: 5,746,931

[45] Date of Patent: May 5, 1998

[54] METHOD AND APPARATUS FOR CHEMICAL-MECHANICAL POLISHING OF DIAMOND

[75] Inventors: John Edwin Graebner, Short Hills; Sungho Jin, Millington; Wei Zhu, Warren, all of N.J.

[73] Assignee: Lucent Technologies Inc., Murray Hill, N.J.

[21] Appl. No.: 760,845

[22] Filed: Dec. 5, 1996

[51] Int. Cl.[6] ..... H01L 21/00

[52] U.S. Cl. ..... 216/88; 156/345; 216/38; 216/53; 216/96

[58] Field of Search ..... 156/345; 216/38, 216/52, 53, 88, 96

[56] References Cited

U.S. PATENT DOCUMENTS

| | | | |
|---|---|---|---|
| 4,690,727 | 9/1987 | Scott et al. | 156/635 |
| 5,382,314 | 1/1995 | Jin | 156/628 |
| 5,500,157 | 3/1996 | Graebner et al. | 264/1.21 |

OTHER PUBLICATIONS

"Reaction of CVD Diamond With Molten Iron Film", Wei et al., Int. Conf. Appl. Diamond Films Relat. Mater., 2nd (1993'), abstract only; Coden: 61 WDAW; Wei et al.

"Preliminary Study of the Chemical Polishing of Alpha–Corundum Surfaces with Vanodium Pentoxide"; Fakton et al.; abstract only; J. Elect. Soc. (1967'); 114 (4).

*Primary Examiner*—R. Bruce Breneman
*Assistant Examiner*—George Goudreau

[57] ABSTRACT

This application describes a new method for rapid thinning, planarizing and fine polishing surfaces of diamond to the submicron/nanometer level so that large area, uniform thickness diamond wafers can be obtained. The method combines both chemical (dissolution of carbon in molten metals) and mechanical (rotating or moving sample fixtures in contact with the dissolving metals) polishing to achieve flat, smooth surface finishes in a relatively short period of time, thus improving the quality and economics of the overall polishing process. Several embodiments of apparatus for performing such chemical-mechanical polishing (CMP) of diamond are described.

10 Claims, 2 Drawing Sheets

METHOD AND APPARATUS FOR CHEMICAL-MECHANICAL POLISHING OF DIAMOND

FIELD OF THE INVENTION

This invention relates to methods and apparatus for etching and polishing diamond. The method uses a porous platen impregnated with molten metal to provide a combination of chemical and mechanical polishing.

BACKGROUND OF THE INVENTION

Diamond has many useful properties. Among the known materials, diamond has the highest mechanical hardness, the highest elastic modulus, the highest atomic density and the highest thermal conductivity at room temperature. In addition, diamond is chemically inert and is transparent to radiation from the ultraviolet to the infrared. Diamond is also a wide band-gap semiconductor useful at high temperature, high power and high frequency. These remarkable properties, in combination with the relative ease of growing diamond films by low pressure chemical vapor deposition (CVD), have made diamond desirable for spreading heat in high power electronic devices, optical windows, low friction and wear resistant surfaces, coatings for cutting tools and components for active electronic devices.

Nearly all diamond applications require shaping, thinning and polishing to produce a finished surface roughness well below one micrometer. Diamond films produced by CVD typically exhibit faceted growth surfaces with significant and undesirable roughness in a range of 10–50 μm depending on the specific film thickness. In addition, the bottom layer of the film (where diamond nucleation and initial growth takes place) consists of fine grains with many structural defects, grain boundaries and regions of impurity segregation, yielding inferior thermal and optical properties. For these reasons, it is desirable to remove both the top and bottom parts of the as-grown CVD films. Unfortunately, because of the hardness of diamond, thinning and polishing by conventional mechanical abrasion is time-consuming and costly.

Low-cost, high speed diamond thinning using diffusional interactions with carbon-dissolving metals have been reported. See, for example, Jin et al. "Shaping of Diamond Films by Etching with Molten Rare-Earth Metals", *Nature*, vol. 362, p. 822, (1993), and Jin et al. "Polishing of CVD Diamond by Diffusional Reaction with Manganese Powders", Diamond and Related Materials, vol. 1, p. 949, (1992). These techniques typically use high temperature reactions at 700°–900° C. and produce etched diamond surfaces with a roughness of about one micron. Further mechanical polishing is required to achieve submicron or manometer scale smooth surfaces. Furthermore, in large-area diamond wafers (for example, >2" in diameter) there often exist thickness gradients, shape distortions or bowing that must be removed to achieve flat, uniform thickness wafers. Accordingly, there is a need for a rapid thinning, planarizing and polishing technique to produce smooth diamond surface finishes.

SUMMARY OF THE INVENTION

This application describes a new method for rapid thinning, planarizing and fine polishing surfaces of diamond to the submicron/nanometer level so that large area, uniform thickness diamond wafers can be obtained. The method combines both chemical (dissolution of carbon in molten metals) and mechanical (rotating or moving sample fixtures in contact with the dissolving metals) polishing to achieve flat, smooth surface finishes in a relatively short period of time, thus improving the quality and economics of the overall polishing process. Several embodiments of apparatus for performing such chemical-mechanical polishing (CMP) of diamond are described.

BRIEF DESCRIPTION OF THE DRAWINGS

The nature, advantages and various additional features of the invention will appear more fully upon consideration of the illustrative embodiments now to be described in detail in connection with the accompanying drawings. In the drawings.

It is to be understood that the drawings are for purposes of illustrating the concepts of the invention and are not to scale.

DETAILED DESCRIPTION

Figure 1:
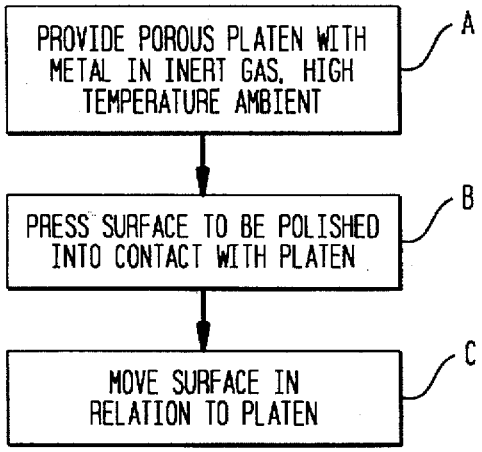
FIG. 1 is a block diagram of the steps involved in polishing diamond.

Referring to the drawings, FIG. 1 is a block diagram of the steps in polishing a diamond surface. As shown in block A of FIG. 1, the first step is to provide, in an inert gas, elevated temperature ambient, a porous platen having a planar polishing surface and further having molten, carbon-dissolving metal in pores adjacent the polishing surface.

The next step (block B) is to press the diamond surface to be polished into contact with the platen.

The third step shown in block C is to move the diamond surface in relation to the platen while the diamond surface is pressed against the platen. This relative motion under pressure in the presence of molten metal polishes and planarizes the diamond surface at a high rate as compared with conventional processes.

In a preferred embodiment the platen has a major surface opposing the planar polishing surface disposed in contact with a source of the molten metal. The pores provide a relatively constant supply of metal to the pores adjacent the polishing surface. In addition, the diamond surface is advantageously rotated in relation to the platen in order to force migration of molten metal which has contacted the surface to be polished radially away from the surface, thereby drawing fresh molten metal toward the surface being polished.

Preferred apparatus for polishing a diamond surface in accordance with FIG. 1 comprises a vessel for maintaining an inert gas, elevated temperature ambient and, disposed within the vessel, a container for molten carbon-dissolving metal. A porous platen having a planar polishing surface is disposed in position for contacting the molten metal. And a movable mount for the diamond material to be polished is provided for pressing the surface to be polished into contact with the polishing surface of the platen and moving the diamond surface in relation to the platen. In a preferred embodiment, the porous platen is a porous ceramic.

The invention can be better understood by consideration of the following specific examples:

EXAMPLE 1

Diamond Polishing Apparatus

Figure 2:
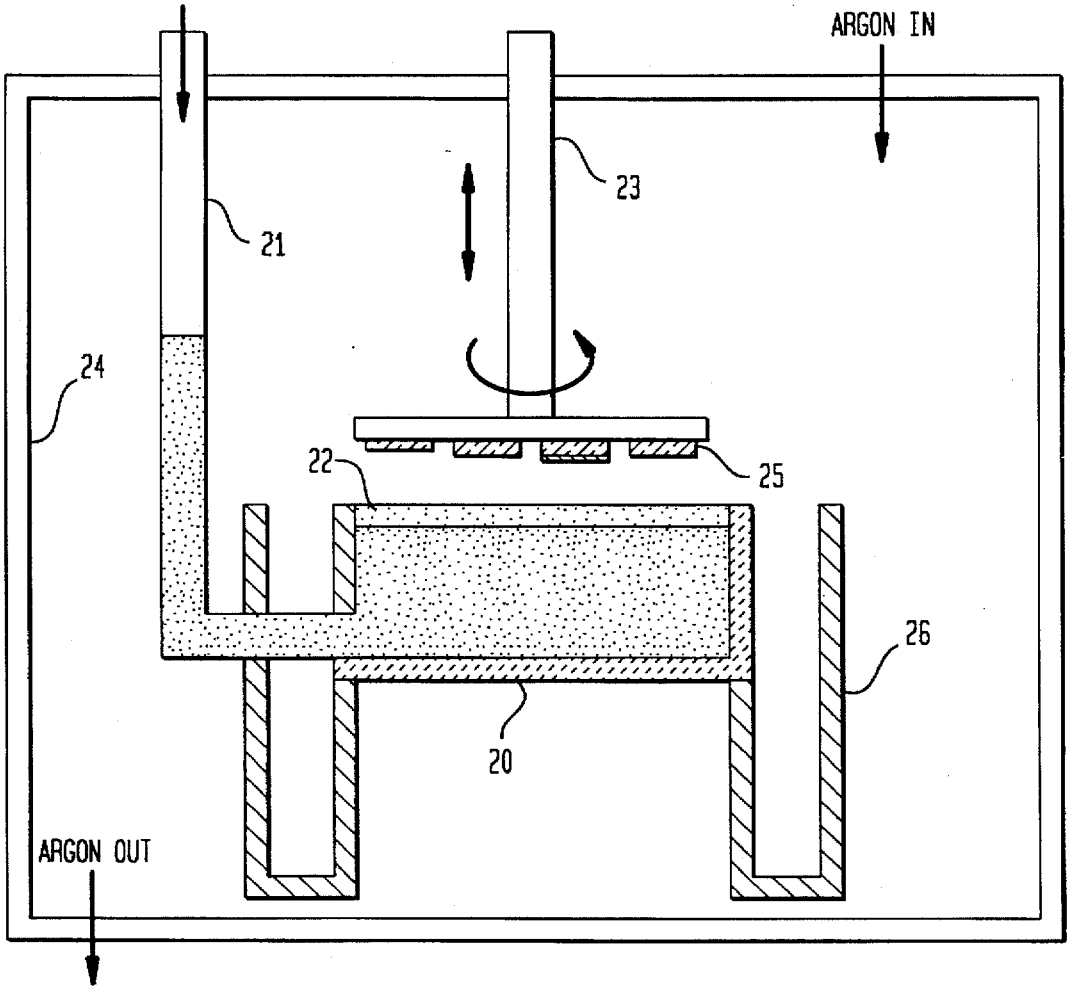
FIG. 2 schematically illustrates a first embodiment of apparatus useful in practicing the process of FIG. 1.

FIG. 2 illustrate a preferred apparatus useful in practicing the method of FIG. 1. The apparatus is comprised of a molten metal container 20 made of, for example, alumina, with attached pressure vessel 21, a perforated platen 22 made of alumina or molybdenum which acts as a stationary polishing surface, and a rotary and vertically linear motion feedthrough 23 which serves as a sample holding fixture. Instead of rotary motion polishing, lateral motion polishing can also be used either alone or in combination with rotation. All these components are sealed in a heating furnace 24 filled with inert gas such as argon. The furnace is maintained at a temperature at least about 50°–100° C. above the melting temperature of the metal being used. For example, for Ce—La mischmetal (23 wt % Ce—53 wt % La—16 wt % Nd—4 wt % Pr) with a melting point of 860° C., a temperature of at least 900° C. is desired. The heating can be performed by conduction or convection in the sealed furnace. Other heating means such as local RF inductive coils disposed around the metal container can also be used. In operation, the diamond samples 25 are mounted on the holding fixture 23 as by vacuum suction, adhesives or mechanical clamping. The fixture is then lowered to press the diamond samples into firm contact with the molten metal surface infiltrated through pores of the polishing platen 22. The fixture is rotated, and the samples are dissolved chemically by the metal and polished mechanically by the platen. The used or carbon-saturated molten metal is pushed into the collector 26 by the mechanical motion of rotation.

EXAMPLE 2

Method of Using Apparatus of Example 1

Figure 3:
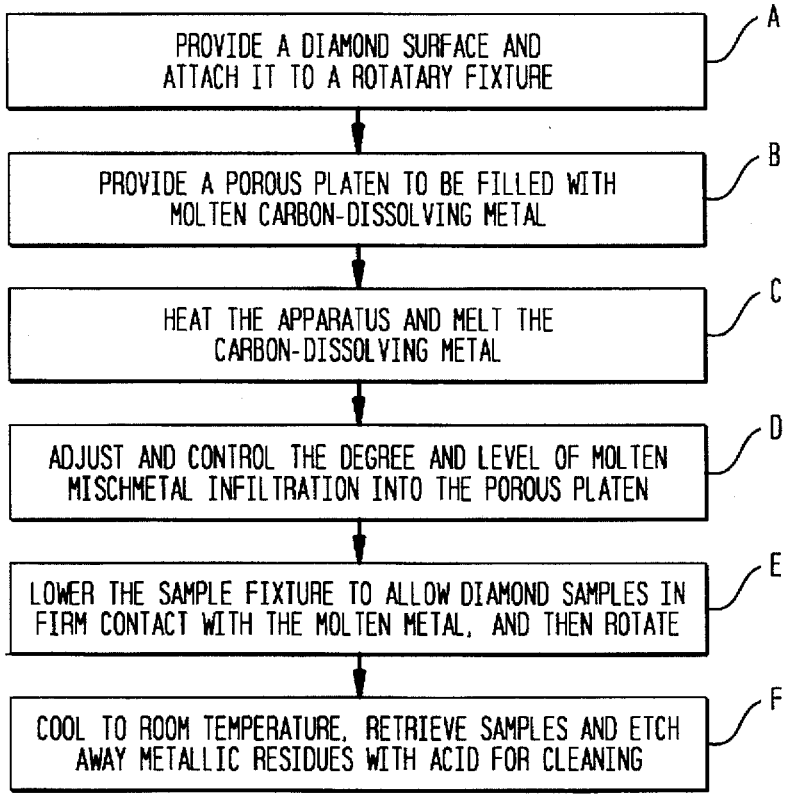
FIG. 3 shows the steps in using the apparatus of FIG. 2.

FIG. 3 is a block diagram of the steps in using the apparatus of FIG. 2 to polish diamond. The first step (block A) is to provide the diamond material having a surface to be polished or planarized. The diamond surface can be as-deposited or with a semi-finished surface ready for final polishing. The diamond material is attached to a rotating disk as by vacuum suction, adhesive or mechanical fixture.

The second step (block B in FIG. 3) is to provide the porous platen having pores containing molten, carbon-dissolving metals. This porous platen is placed inside the molten metal container and on top of the molten metal surface. The molten metal can thus infiltrate into the porous platen and further rise to the top surface of the platen to act as the chemical medium for dissolving carbon. The platen preferably has a planar surface pre-polished to sub-micrometer, or preferably less than 1000 angstrom, or more preferably less than 100 angstrom surface roughness. The preferred porosity is greater than 50% for ease of molten metal infiltration and transport but less than 90% to preserve the mechanical integrity and strength of the platen. Suitable porous materials must first resist substantial chemical attack from the molten metal at high processing temperatures, and secondly be mechanically hard and strong so that the wear during diamond polishing is not extensive. Preferred materials include stable oxides. Most preferable are rare earth oxides such as Ce-oxide, Y-oxide and La-oxide. Other materials such as $Al_2O_3$, $ZrO_2$ or MgO, carbides or nitrides, or refractory metals such as Mo, Ta, Zr, Nb or W can also be used. Such materials can be partially sintered under light compaction to yield the desired porosity. Instead of a hard sintered body, the platen can comprise a flexible body such as a refractory metal open mesh screen (e.g. Mo screens) or a tangled metal web of refractory fibers. The flexible platen accommodates height or thickness variations across the samples. The flexibility also accommodates undesirable variation in the contact pressure or undesirable wobbly motion which is not readily accommodated by hard platens.

The third step (block C in FIG. 3) is to heat to melting the metal or alloy which is used to chemically dissolve diamond. Such carbon-dissolving metals include transition metals such as Mn or Fe or alloys thereof, and preferably rare earth metals with low melting temperatures such as Ce, La, Y, Yb, Pr, Eu, eutectic or near-eutectic alloys comprising rare earth metals such as Ce—La mischmetal, La—Ni alloys and Ce—Ag alloys. The Ce—La mischmetal is preferred because it exhibits a high solubility of carbon and very rapid dissolution kinetics. In addition, mischmetal is commercially available in large quantities at low price.

The temperature must be kept high enough to keep the metals or alloys in a molten state. Typically, a processing temperature at least 50°–100° C. above the melting temperature of the metal will be appropriate. The use of still higher processing temperatures is not excluded because higher temperatures provide increased solubility of carbon in the metals as well as enhanced kinetics and hence shorter processing time durations. Processing at temperatures too high (e.g. >1,000° C.) is not desirable because of difficulty in handling and maintaining the apparatus.

The Ce—La mischmetal has a melting temperature of ~860° C. Additions of some metallic impurities such as Ni, Cu, Co, Al, Ag, Zn, Ga, Fe, Mn, Pd, Pt, Ru, Rh, In, Si, Ge, Au and Mg can further lower its melting temperature. For example, the addition of nickel (88 wt % Ce—La mischmetal+12 wt % Ni) lowers the melting, temperature to ~500° C., and the addition of copper (85 wt % Ce—La mischmetal+15 wt % Cu) decreases the melting temperature to ~450° C. The lowering of the melting temperatures of the rare earth metals by alloying with other metallic impurities, allows the chemical polishing (that is, the dissolution of carbon in metals) to be performed at substantially lower temperatures than the rare earth metals or alloys alone. Such lower processing temperatures are desirable for ease of processing, minimization of damage to sensitive components, safety and cost-saving, especially in industrial practice.

Some of the exemplary metallic impurities (such as Ni, Co, Ag, Al) contained in the rare earth metals also contribute to improved corrosion resistance as compared with pure rare earth metals. Pure rare earth metals are very reactive, and they often oxidize in air so rapidly that it requires the use of inert atmosphere to avoid fire hazards. The alloys containing the exemplary impurities (mentioned above) are less prone to oxidation and hence can be used for diamond polishing in less pure inert atmosphere.

One or more rare earth metals can be used in the alloy mixture, in combination with one or more metallic impurities. The quantitative composition depends on the desired melting point, desired corrosion/oxidation resistance, and other desired physical characteristics. A useful approximate composition range of each metallic impurity in the alloy mixture is 2–50 wt %. An advantageous approximate range is 5–30 wt %; and a preferred approximate range is 10–20 wt %.

The mischmetal or alloy mixture can be provided in the form of sheets, blocks, or powders. They are placed in a container/reservoir (see FIG. 2) made of materials which are non-reactive or minimally reactive with rare earth metals at the high processing temperatures. Exemplarily these materials include ceramics, preferably the oxides of the carbon-dissolving rare earth metals or alloys such as Ce-oxide, Y-oxide, La-oxide, mischmetal oxide, $Al_2O_3$, $ZrO_2$ or MgO, carbides or nitrides, or refractory metals such as Mo, Ta, Zr, Nb or W. During operation, the container is sealed and kept in an inert atmosphere (such as argon or helium gas). The use of a reducing atmosphere (such as hydrogen gas) is not desirable as the rare earth metals tend to form hydrides with undesirably high melting temperatures. The container is attached with a pressure vessel on its side, and the molten metals can flow freely between this pressure vessel and the container. The purpose of this pressure vessel is to control the level of the molten metal inside the container by exposing the vessel to variable external pressures, and by adjusting the pressure, the surface level of the molten metal inside the container can correspondingly move up and down.

The fourth step (block D in FIG. 3) is to adjust the level of molten metal or the degree of molten metal infiltration into the porous platen by controlling the pressure inside the attached vessel. Accurate control of the level of this molten metal surface is useful for determining the rate and degree of diamond polishing, because the amount of molten metal exposed to diamond (that is, the amount of molten metal on or above the porous platen which comes into contact with the diamond) will determine the upper limit of the amount of diamond being dissolved due to the solubility saturation effect.

The fifth step (block E in FIG. 3) is to lower the fixture (diamond mount) so that the attached diamond samples are pressed into firm contact with the molten metal infiltrated through the porous platen. For the purpose of high speed and uniform polishing, the fixture is in a state of rotating motion with a speed in the range of 10–10,000 rpm, and preferably in the range of 100–1,000 rpm. The inventive diamond dissolves at a rate of at least 10 μm/min, preferably higher than about 50 μm/min. The rotation will ensure constant contact with fresh molten metal because the used or saturated molten metal is forced to migrate radially by the rotation, and fresh molten metal is continuously replenished to the local (or higher) points of diamond surface exposed by the mechanical abrasion. The rotation also reduces local non-uniform etching and polishing, yielding a smooth and uniform polished surface. By controlling the rotating speed and the amount of infiltrated molten metal, the polish rate is controlled. An accurate dimensional control is thus possible. The desirable polishing time duration can be in the approximate range of 0.01–10 hours, preferably 0.1–1 hour, depending on the processing temperature and the desired reduction in thickness and thickness gradient.

The mechanical polishing employed here is not conventional mechanical polishing. Here the diamond is harder than the platen material. The mechanical motion supplies fresh molten metal with more potent solubility for carbon, at the same time removing the used molten metal with less solubility. High speed diamond etching and polishing can thus be continued without the unavoidable slowing down in conventional thermal/chemical processing.

The final step (block F in FIG. 3) is to retrieve the samples after the polishing is completed. Any unreacted or reacted metallic residues can be removed by wet chemical etching in acids. The polished diamond surface can be given additional finishing such as local area laser polishing to impart fine geometrical patterns. A laser device or a semiconductor integrated circuit device can then be bonded to the polished diamond surface serving as a submount. The diamond can be further bonded to a metallic heat-sinking body if desired.

This CMP technique can also be applied to single crystalline or polycrystalline diamond bodies or pieces, natural or synthetic, for the purpose of shaping, planarizing and polishing them. In addition, it can be used for other metal-soluble materials such as nitride and carbide materials. In the case of nitrides, metals with relatively high solubility of nitrogen can be used which include V, Zr, Fe, Ce, La or their alloys. Technologically important nitrides such as c-BN, AlN, GaN, InN or their alloys can be fine polished for electronic, optical and acoustic applications. In these cases, the metal removes the nitrogen, and the acid and base solutions remove the metallic element from the nitrides being polished. For this technique to be useful for these and other materials, the thermodynamic conditions of the specific involved materials under the CMP conditions (i.e. temperature and pressure) should be such that the material dissolves in the metals with a net decrease in free energy.

Figure 4:
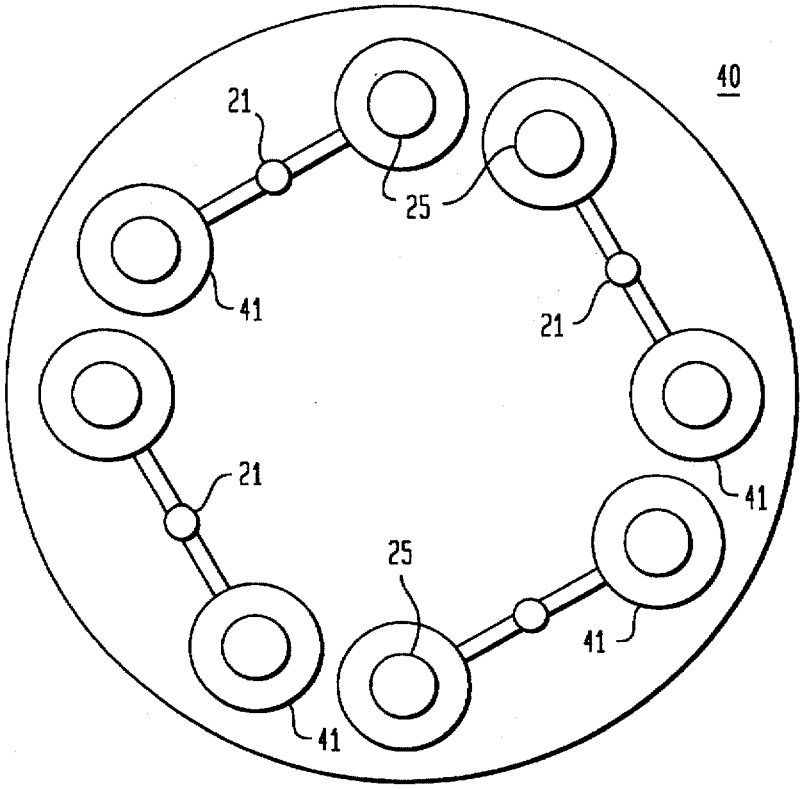
FIG. 4 illustrates a second embodiment of apparatus.

Multiple polishing stations can be designed so that numerous samples can be simultaneously planarized and polished. Shown in FIG. 4 is one example of such a multi-station CMw apparatus 40 which incorporates 8 rotating wheels 41.

It is to be understood that the above-described embodiments and examples are illustrative of only a few of the many possible specific embodiments which can represent applications of the principles of the invention. Numerous and varied other arrangements can be devised by those skilled in the art without departing from the spirit and scope of the invention.

What is claimed is:

1. A method for polishing a surface of diamond, nitride or carbide comprising the steps of:

providing in an inert gas, elevated temperature ambient, a porous platen having a planar surface and molten metal in pores adjacent said surface;

pressing said surface to be polished into contact with said platen planar surface; and moving said surface to be polished in relation to said platen surface to effect polishing.

2. The method of claim 1 wherein said porous platen is disposed in contact with a source of said molten metal for supplying said molten metal through pores to said planar surface.

3. The method of claim 1 wherein said surface to be polished is rotated in relation to said platen surface for forcing migration of said molten metal contacting said surface to be polished.

4. The method of claim 1 wherein said surface to be polished comprises diamond and said molten metal comprises a molten rare earth metal.

5. The method of claim 1 wherein said platen is provided in an ambient having a temperature which is at least 50° C. greater than the melting temperature of said metal.

6. Apparatus for polishing a surface of diamond, nitride or carbide comprising:

a vessel for maintaining an inert gas, elevated temperature ambient;

a container for molten metal disposed within said vessel;

a porous platen having a planar outer surface, said platen having a planar outer surface, said platen disposed within said vessel in position for contacting said molten metal in said container;

a movable mount for the material to be polished, said mount movable for pressing said surface to be polished into contact with the planar surface of said platen and for moving said surface to be polished in relation to said planar surface to effect polishing.

7. Apparatus according to claim 6 wherein said movable mount is movable for rotating said surface to be polished in relation to said planar surface.

8. Apparatus of claim 6 wherein said porous platen comprises porous ceramic.

9. Apparatus of claim 6 wherein said porous platen comprises a flexible open screen of refractory metal.

10. Apparatus of claim 6 wherein said porous platen comprises a flexible web of refractory fibers.

* * * * *